US008468774B2

(12) United States Patent
Garry

(10) Patent No.: US 8,468,774 B2
(45) Date of Patent: Jun. 25, 2013

(54) STRUCTURAL BUILDING COMPONENTS AND METHOD OF CONSTRUCTING SAME

(75) Inventor: Matthew John Joseph Garry, Kingsthorpe (AU)

(73) Assignee: QLD Steel Pty, Ptd., Queensland (AU)

( * ) Notice: Subject to any disclaimer, the term of this patent is extended or adjusted under 35 U.S.C. 154(b) by 94 days.

(21) Appl. No.: 12/937,085

(22) PCT Filed: Apr. 9, 2009

(86) PCT No.: PCT/AU2009/000448

§ 371 (c)(1),
(2), (4) Date: Feb. 1, 2011

(87) PCT Pub. No.: WO2009/124356

PCT Pub. Date: Oct. 15, 2009

(65) Prior Publication Data

US 2011/0113725 A1 May 19, 2011

(30) Foreign Application Priority Data

Apr. 11, 2008 (AU) ..... 2008901785

(51) Int. Cl.
*E04C 3/00* (2006.01)

(52) U.S. Cl.
USPC ..... 52/840; 52/836; 52/837; 52/838; 52/839

(58) Field of Classification Search
USPC ..... 52/836, 837, 838, 839, 840, 696
See application file for complete search history.

(56) References Cited

U.S. PATENT DOCUMENTS

| | | | | |
|---|---|---|---|---|
| 1,649,577 | A * | 11/1927 | Coryell | 52/691 |
| 1,975,228 | A | 10/1931 | Grumman | |
| 2,101,090 | A * | 12/1937 | Palmer | 52/210 |

(Continued)

FOREIGN PATENT DOCUMENTS

| | | |
|---|---|---|
| AU | 199676446 | 6/1997 |
| GB | 1011092 | 11/1965 |
| WO | 00/34599 | 6/2000 |
| WO | 2005/042869 | 5/2005 |

OTHER PUBLICATIONS

International Preliminary Report on Patentability based on Australian Application No. PCT/AU2009/000448 dated Sep. 23, 2009.

(Continued)

*Primary Examiner* — Jeanette E Chapman
*Assistant Examiner* — James Buckle, Jr.
(74) *Attorney, Agent, or Firm* — Baker Donelson Bearman Caldwell & Berkowitz, PC

(57) ABSTRACT

Structural building components and a method of constructing the same enable improved beams that can be constructed at a place of use. The method includes providing a first flange (16) and a second flange (18) defining a central beam axis (55). A number of separately formed web sections (12) are provided, each having two convergent side walls (42) and a central wall (40) extending between converging ends of the side walls (42). The web sections (12) are arranged side by side in an alternating arrangement wherein the central walls (40) of adjacent web sections (12) are spaced substantially parallel to each other and are transversely staggered relative to the central beam axis (55). The side walls of adjacent web sections (12) are connected to one another, and the web sections (12) are connected to both the first flange (16) and second flange (18).

19 Claims, 11 Drawing Sheets

U.S. PATENT DOCUMENTS

| | | | | | |
|---|---|---|---|---|---|
| 2,205,725 | A | * | 6/1940 | Kavanagh | 52/481.1 |
| 2,656,999 | A | * | 10/1953 | Ullberg, Jr. | 248/68.1 |
| 3,300,839 | A | * | 1/1967 | Lichti | 29/897.35 |
| 3,362,056 | A | * | 1/1968 | Preller et al. | 29/897.35 |
| 4,147,379 | A | | 4/1979 | Winslow | |
| 4,232,845 | A | * | 11/1980 | Turner | 248/49 |
| 4,885,892 | A | | 12/1989 | Gooding | |
| 5,165,213 | A | * | 11/1992 | Finch et al. | 52/588.1 |
| 5,417,022 | A | * | 5/1995 | Ritchie | 52/309.13 |
| 5,470,021 | A | * | 11/1995 | Looney | 248/49 |
| 5,816,012 | A | * | 10/1998 | Willis | 52/696 |
| 6,205,725 | B1 | * | 3/2001 | Butler | 52/292 |
| 6,415,577 | B1 | | 7/2002 | Curtis | |
| 6,826,884 | B2 | * | 12/2004 | Pabedinskas et al. | 52/839 |
| 7,127,862 | B2 | * | 10/2006 | Saldana | 52/715 |
| 2007/0056246 | A1 | * | 3/2007 | Escobar Benavides et al. | 52/729.1 |

OTHER PUBLICATIONS

International Search Report based on Australian Application No. PCT/AU2009/000448 dated Jun. 9, 2009.

* cited by examiner

STRUCTURAL BUILDING COMPONENTS AND METHOD OF CONSTRUCTING SAME

CROSS REFERENCE TO RELATED APPLICATIONS

This application is a §371 National Stage Application of PCT/AU2009/000448 filed Apr. 9, 2009, which claims priority to Australian Application No. 2008901785 filed Apr. 11, 2008.

The present invention relates generally to building components used in the building industry; in particular, although not exclusively, the invention relates to beams and building elements for the construction of buildings with roofs spanning large distances.

BACKGROUND TO THE INVENTION

There are many instances in building construction requiring roofs covering large areas that are not obstructed with intermediate vertical supporting members such as columns. An example is a sporting or events stadium, where unobstructed views can be sold for premium prices. Seats in stadia with obstructed views are sold much more cheaply than those with a clear view. Another example of such a building is an aircraft hangar that must be wide enough and high enough to accommodate an aircraft having a large wing span and a high tail structure. This is especially true with the advent of so called "super-jumbos" such as the Airbus A380.

Various geometric shapes have been proposed in the prior art for roof structures that effectively cover a large area at a relatively low cost and without the use of intermediate supports. For example, it has been proposed that a roof have the shape of a hyperbolic paraboloid. However, such a roof structure may not be suitable as an aircraft hangar as its shape is predominantly ovular and may not be able to cover large aircraft.

Also, various materials are used in the building industry to form roof trusses. For example wood has been used for centuries to form roof trusses, while large modern buildings often employ steel roof trusses to span the width of a building. The I-beam (so called because of the shape of its cross section) also has been used to increase the strength and rigidity of roofs and reduce the weight of a roof structure. To create an I-beam steel webbing can be inserted between two parallel sections of steel. The design increases the torsional strength and moment of inertia of a beam while reducing the weight compared to a solid rectangular beam. Other materials used for beams include composites, alloys and plastics to prevent corrosion caused by chemicals and/or chemical reactions in environments such as phosphate storage facilities and acid storage facilities (e.g., galvanizing plants).

I-beams engineered from wood with fibreboard and a laminated veneer are also becoming increasingly popular in construction, especially residential construction, as such beams are both lighter and less prone to warping than solid wooden beams. However wooden I-beams can suffer a rapid loss of strength in a fire if left unprotected.

Similar to an I-beam, Australian Patent No. 716272 to Berryman discloses roofing beams made of sections that are then bolted or welded together. Each section consists of two parallel rectangular hollow tubes to reduce weight. A metal webbing is welded to the two parallel rectangular hollow tubes in a zig-zag pattern. The result is a lighter, more rigid structure.

However, disadvantages of the Berryman invention include accelerated corrosion rates due to pooling of water on the beam during storage and transportation. Such beams, even when painted or galvanized, once exposed to water when lying flat in a storage position may begin to rust or exfoliate.

The Berryman invention requires a coil of steel to be cut or slit to different widths to accommodate a range of beam sizes, then pressed to form its final shape. This process requires additional specialist equipment to cut the coil. This manufacturing process also requires carrying large stock levels of numerous different beam sizes. Also, due to long beam lengths specialist transportation companies may need to be enlisted to transport the beams.

There is therefore a need for improved beams that increase spanning capability, reduce corrosion, and are relatively easily manufactured and transported.

OBJECTS OF THE INVENTION

It is an object of the present invention to overcome and/or alleviate one or more of the above disadvantages or provide the consumer with a useful or commercial alternative.

It is a further object of some embodiments of the present invention to provide a beam having high torsional strength.

It is a further object of some embodiments of the present invention to provide a beam that is relatively easily manufactured and comprising components that are easily transportable to be assembled on-site.

It is a further object of some embodiments of the present invention to enable use of a single steel coil width for a variety of beam sizes.

It is a further object of some embodiments of the present invention to provide a beam that has reduced risk of corrosion, from water pooling, when in storage or when placed in a position open to the elements.

It is a further object of some embodiments of the present invention to provide corrosion-resistant beams for use in highly corrosive environments.

It is a further object of some embodiments of the present invention to provide a connection system for a beam structure to improve transportation, fabrication and construction of the structure.

SUMMARY OF THE INVENTION

According to one aspect, the present invention is a method of constructing a beam, the method comprising:

providing a first flange and a second flange defining a central beam axis;

providing a number of separately formed web sections each having two convergent side walls and a central wall extending between converging ends of the side walls, arranging the web sections side by side in an alternating arrangement wherein the central walls of adjacent web sections are spaced substantially parallel to each other and are transversely staggered relative to the central beam axis;

connecting the side walls of adjacent web sections to one another; and connecting the web sections to both the first flange and second flange.

Preferably, the web sections are arranged so that edge regions of adjacent side walls overlap.

Optionally, the method includes connecting the side walls of adjacent web sections to each other by passing fasteners through the region of overlap between adjacent side walls. Alternatively, the side walls of adjacent web sections are welded to one another.

In one embodiment of the invention, the central walls include gusset sections which extend past the upper or lower edges of the side walls and the method of constructing the beam includes positioning the flanges between the gusset sections.

Preferably, the gusset sections are flush with central walls of the web sections.

According to another aspect of the invention, the present invention is a method of constructing a building element which includes constructing at least two beams as claimed in any one of the preceding claims, and rigidly connecting the beams at an angle relative to each other by inserting parts of the flanges of each of the beams into holding channels of a connector and fixing the beams to the connector.

Preferably, the method includes inserting parts of the flanges into holding channels of a bracket, and fixing the beams to the bracket.

According to yet another aspect of the invention, the present invention is a beam comprising:

a first flange defining a central beam axis;

a second flange spaced parallel to the first flange; and a number of separately formed web sections fixed between the first flange and the second flange, each of the web sections having two convergent side walls and a central wall extending between converging ends of the side walls;

the web sections being arranged side by side in an alternating arrangement wherein the central walls of adjacent web sections are spaced substantially parallel to each other and are transversely staggered relative to the central beam axis, and the convergent side walls of adjacent web sections overlap.

The beam may include fasteners passing through a region of overlap between adjacent side walls or the side walls of adjacent web sections may be welded to one another.

In one embodiment of the present invention the central walls include gusset sections which extend past the upper or lower edges of the side walls and the flanges are positioned between the gusset sections.

Preferably, the central walls have a strengthening structure comprising a channel or fold formed therein which extends between the upper and lower edges of the central walls.

Optionally, the central walls have holes defined therein.

The web sections may comprise steel, aluminium, plastics or composite material.

The present invention extends to a building element comprising:

two beams as defined and described hereinabove; and a connector having two pairs of holding channels extending at an angle relative to each other, wherein parts of the flanges of each of the beams are received in a different pair of holding channels and fixed thereto.

The present invention also extends to a building element comprising:

a beam as defined and described hereinabove; and a bracket having a pair of holding channels that receives ends of the first and second flanges.

BRIEF DESCRIPTION OF THE DRAWINGS

By way of example only, preferred embodiments of the invention will be described more fully hereinafter with reference to the accompanying figures, wherein.

DETAILED DESCRIPTION OF THE PREFERRED EMBODIMENT

Figure 1:
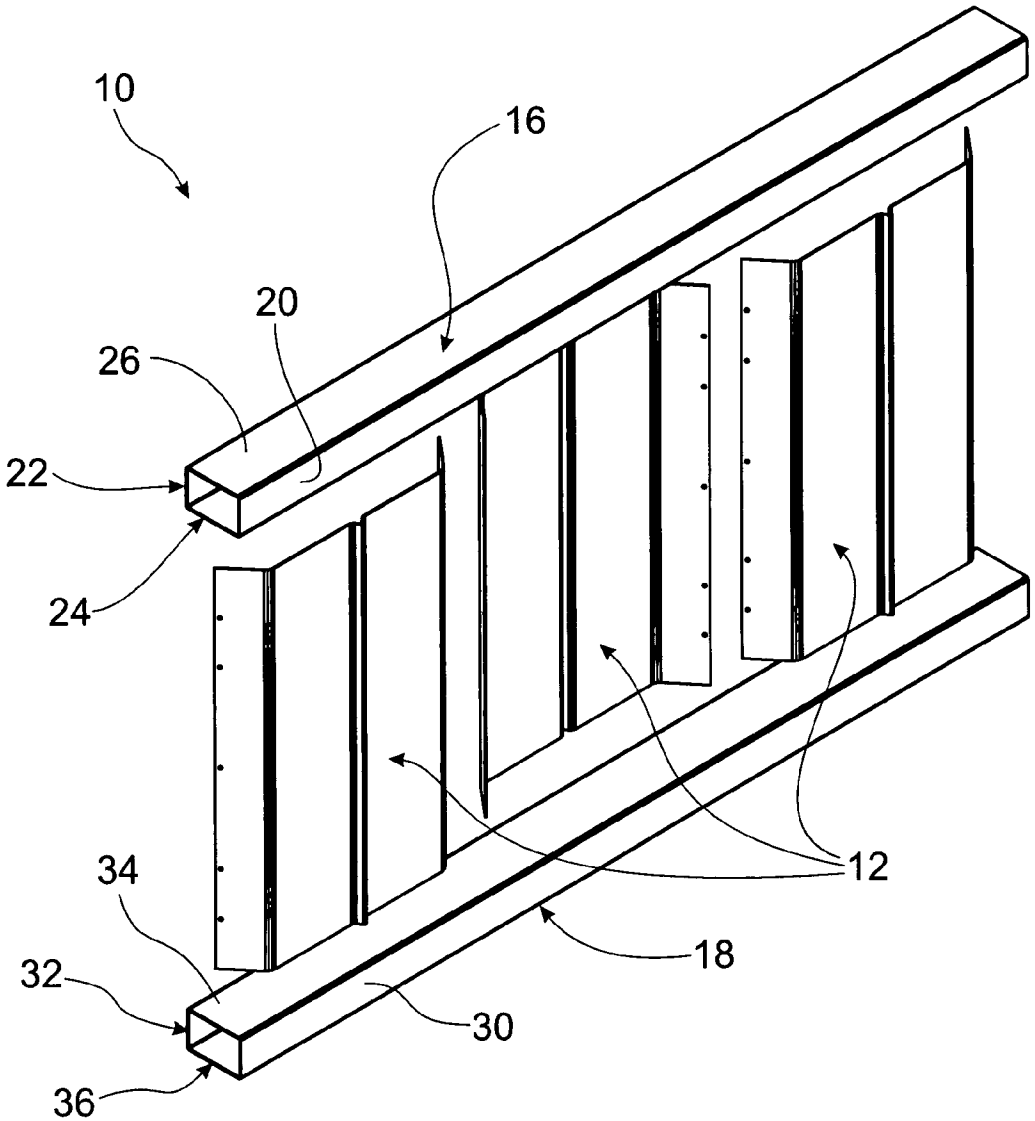
FIG. 1 shows a perspective exploded view of a beam according to an embodiment of the present invention.

The present invention relates to improved beams and building elements, and methods of constructing them. Elements of the invention are illustrated in concise outline form in the drawings, showing only those specific details that are necessary to understanding the embodiments of the present invention, but so as not to clutter the disclosure with excessive detail that will be obvious to those of ordinary skill in the art in light of the present description.

In this patent specification, adjectives such as first and second, left and right, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

FIG. 1 shows an exploded view of a beam 10. The beam 10 comprises a number of web sections in the form of webs 12, a first flange 16 and a second flange 18.

The first flange 16 and the second flange 18 are preferably made from a rectangular cross-section steel bar, however any other suitable material may be used. The first flange 16 comprises a front surface 20, a back surface 22, a bottom surface 24 and a top surface 26. The second flange 18 comprises a front surface 30, a back surface 32, a top surface 34 and a bottom surface 36. The second flange 18 is spaced substantially parallel to the first flange 16 and the bottom surface 24 of first flange 16 faces the top surface 34 of the second flange 18. The first and second flanges 16, 18 are of substantially equal length.

Figure 3:
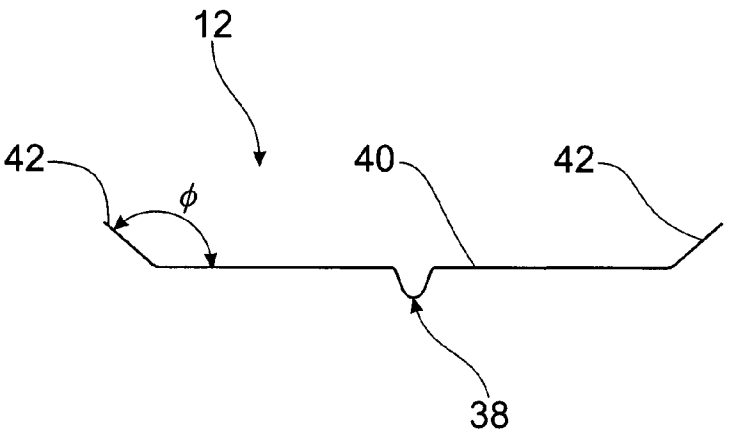
FIG. 3 shows a cross-section of the web of FIG. 2.
Figure 2:
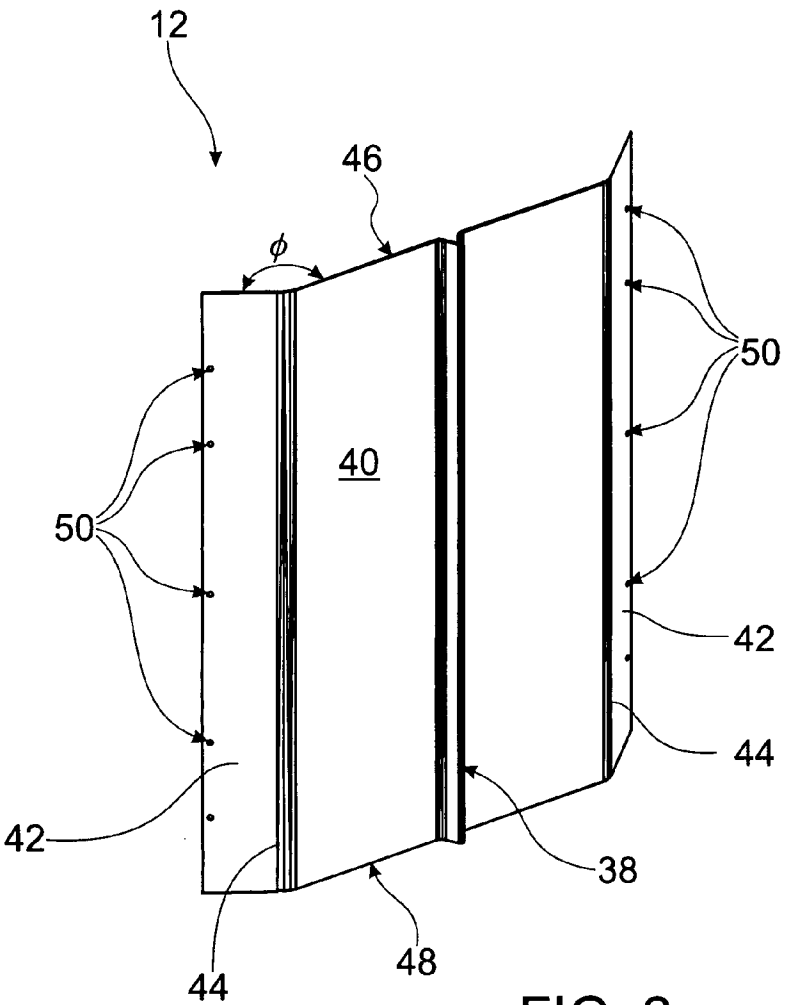
FIG. 2 shows a perspective view of one of the webs of the beam of FIG. 1.

FIG. 2 shows a perspective view of one web 12, and FIG. 3 shows a cross-section through the web 12. Each web 12 comprises a central wall 40 and two side walls 42 that angle away from a plane of the central wall 40. The side walls 42 are convergent, with the central wall 40 extending between converging ends of the side walls 42. The length of walls 42 are such that they overlap when a second, inverted web 12 is placed next to a first web 12. The side walls 42 have holes 50 at distal end regions thereof. A fold line 44 is defined at the converging ends of the side walls 42, where the side walls 42 meet the central wall 40. An angle θ between the central wall 40 and each side wall 42 is approximately 135 degrees. The angle θ may similarly be between 130 degrees and 150 degrees depending on requirements. The webs 12 have a first edge 46 adjacent the first flange 16 and a second edge 48 adjacent the second flange 18. The webs 12 include a strengthening structure 38 in the form of a V-shaped fold which extends down the centre of the central wall 40 from the first edge 46 to the second edge 48. The strengthening structure 38, as well as increasing the rigidity of the beam 10, allows liquid trapped between the web 12 and the flanges 16, 18 to drain from the beam 10 thus preventing corrosion of the beam 10. This is particularly effective when the beams 10 are stored in a horizontal position.

Each web 12 may be manufactured from a single plate of steel; however any other appropriate material may such as aluminium, plastic or composite materials may be used to create a series of rolled profiles as is known to a person skilled in the art.

Figure 4:
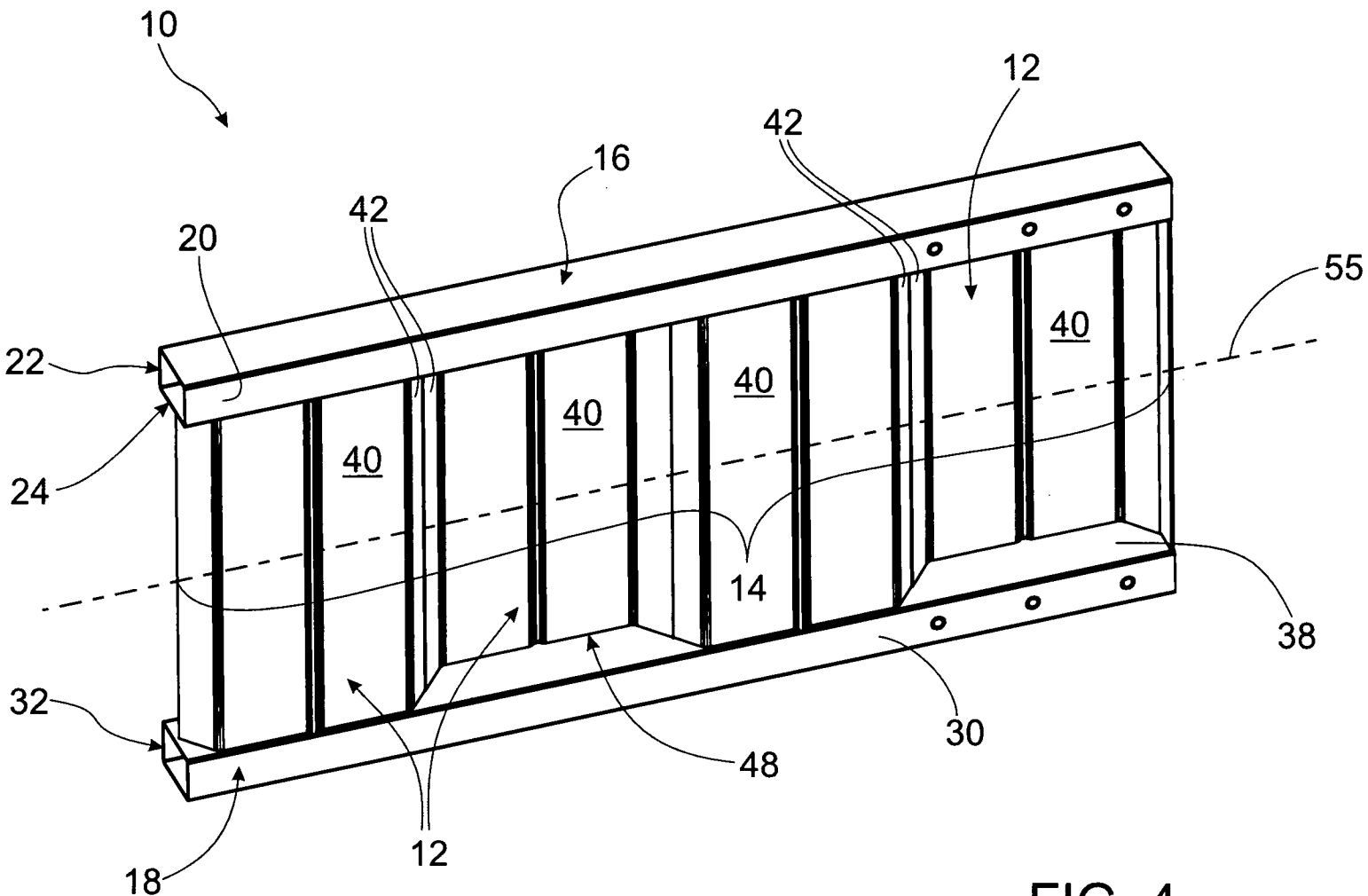
FIG. 4 shows a perspective assembled view of the beam of FIG. 1.

FIG. 4 shows an assembled view of the beam 10. The beam 10 is constructed as described hereinbelow. The webs 12 are fixed side by side to form a composite web 14. The first flange 16 and the second flange 18 are connected by the composite web 14. The first flange 16 and the second flange 18 define a central beam axis 55. The first edge 46 of the webs 12 are fixed to the bottom surface 24 of the first flange 16 and the second edge 48 is fixed to the top surface 34 of the second flange 18. The webs 12 are arranged in an alternating arrangement wherein the central walls 40 of adjacent webs are spaced substantially parallel and are transversely staggered relative to the central beam axis 55, and the side walls 42 of adjacent webs 12 abut one another. The side walls 42 of adjacent webs 12 are fixed to one another by riveting, bolting or screwing the side walls 42 together using the holes 50. Alternatively, the webs 12 may be welded or chemically bonded into position. It will be appreciated that the webs 12 may be fixed to one another to form the composite web 14 before fixing the flanges 16, 18 to the composite web 14; alternatively, the webs 12 may be fixed to one another in-situ between the flanges 16,18 as they are being fixed to the flanges 16, 18.

The central wall 40 of one web 12 is co-planar with the front surfaces 20, 30 of the flanges 16, 18, respectively, and the central wall 40 of adjacent webs 12 are co-planar with the rear surfaces 22, 32 of the flanges 16,18 respectively. As such, the central walls 40 of adjacent webs 12 are spaced substantially parallel to each other and are transversely staggered relative to the central beam axis 50.

Figure 5:
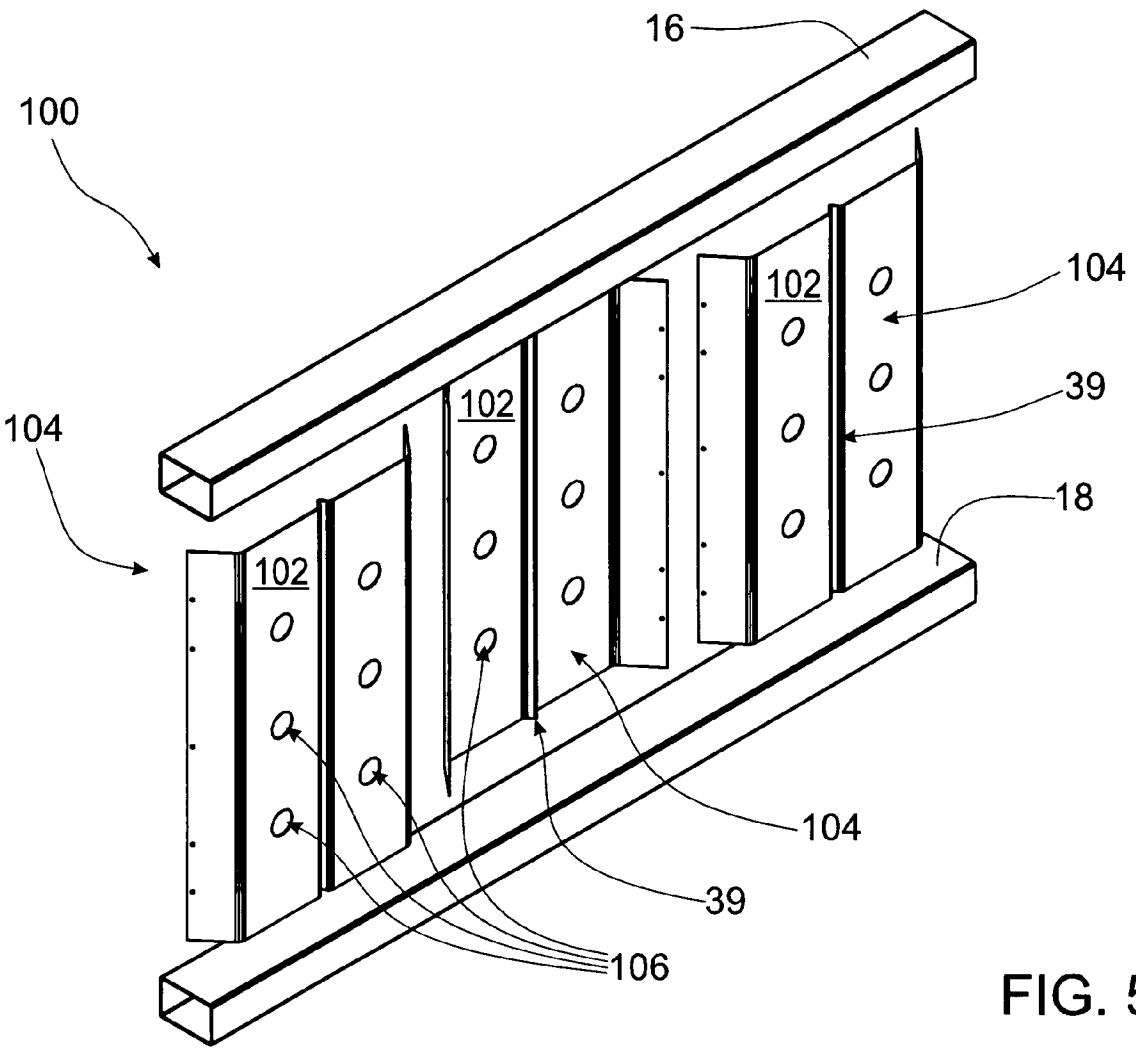
FIG. 5 shows a perspective exploded view of another embodiment of a beam according to the present invention.

FIG. 5 shows a perspective exploded view of a beam 100 according to an alternative embodiment of the present invention. The beam 100 is similar to the beam 10, with a difference being holes 106 defined in central walls 102 of webs 104 of the beam 100 and a strengthening structure 39 being inverted when compared to the strengthening structure 38.

Figure 6:
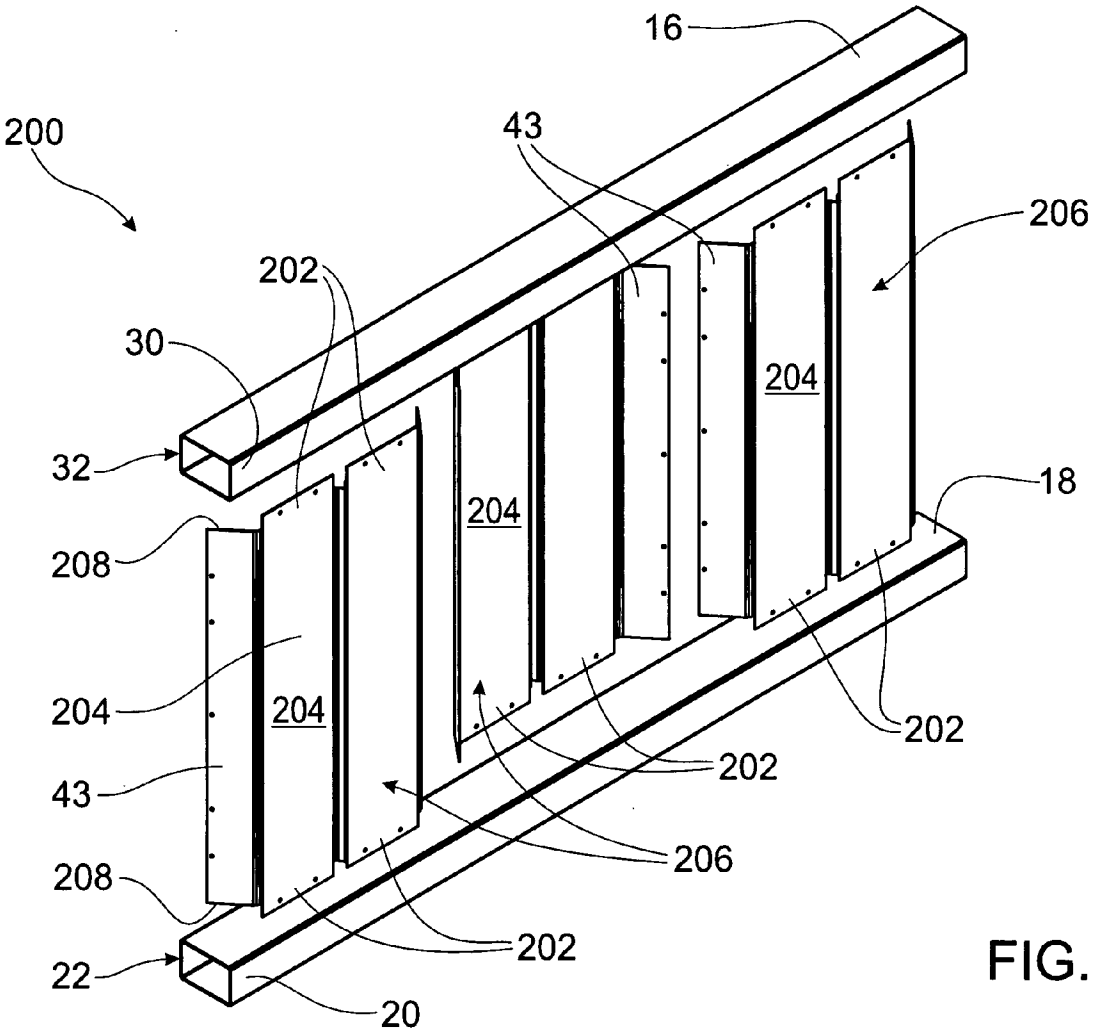
FIG. 6 shows a perspective exploded view of yet another embodiment of a beam according to the present invention.

FIG. 6 shows a perspective exploded view of a beam 200 according to yet another alternative embodiment of the present invention. The beam 200 is similar to the beam 10, with a difference being gusset sections 202 integrally formed with the central wall 204 of the webs 206. The gusset sections 202 extend past opposite edges 208 of side walls 43. The gusset sections 202 are flush with the central walls 204. In an assembled condition of the beam 200, the flanges 16, 18 are received between the gusset sections 202 of the webs 206. The first flange 16 is placed on the webs 206 and between the gusset sections 202 of adjacent webs and for example welded, braised, riveted or glued into position. Similarly, the second flange 18 is placed on the webs 206 and welded, braised, riveted or glued into position. The webs 206 are fixed to one another in the same manner as described for the webs 12, to thereby form a composite web fixed between the flanges 16,18. The gussets sections 202 enable a strong connection to be made between the webs 206 and the flanges 16,18 because rivets, bolts and spot welds for example can be placed directly through the gussets sections 202 and the front surfaces 20, 30 and back surfaces 22, 32 of the flanges 16, 18.

Figure 7:
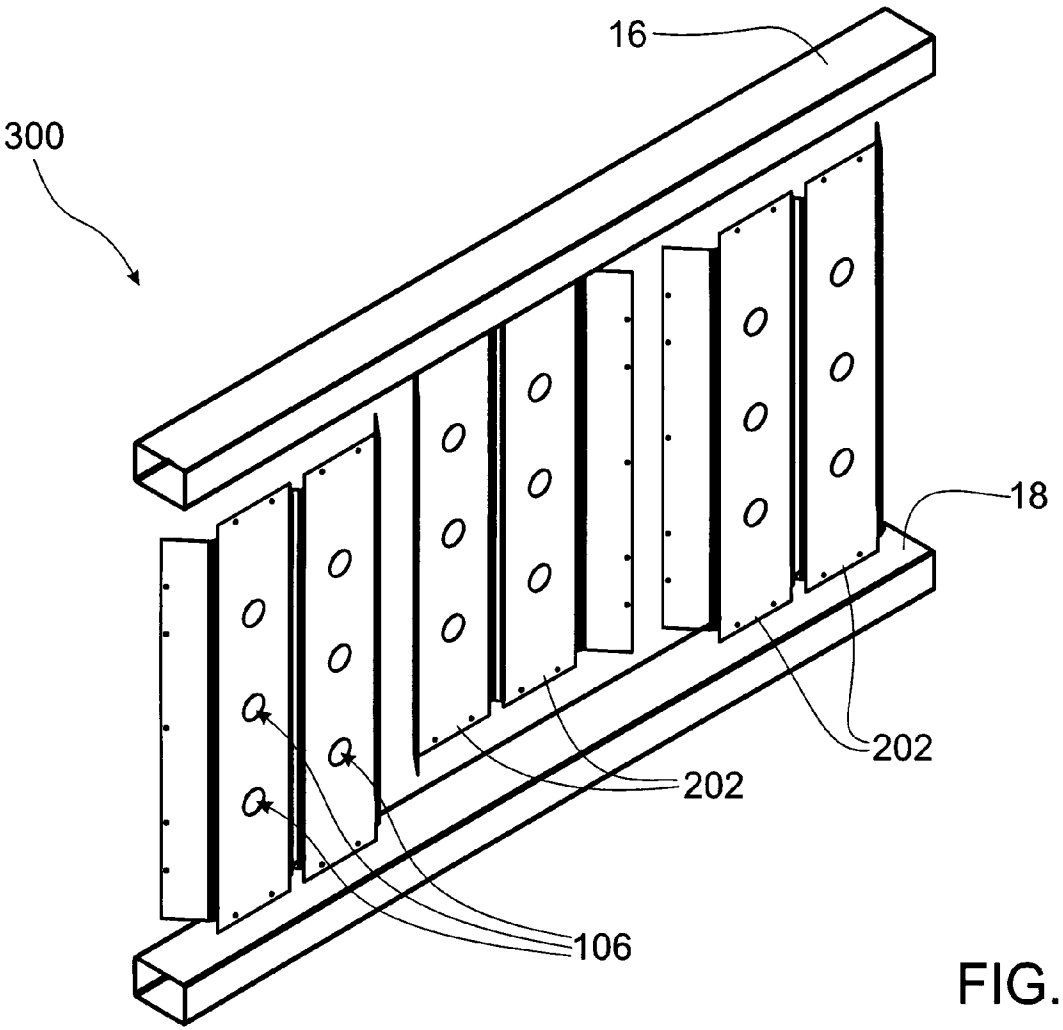
FIG. 7 shows a perspective exploded view of still another embodiment of a beam according to the present invention.

FIG. 7 shows a perspective exploded view of a beam 300 according to still another alternative embodiment of the present invention. The beam 300 is similar to the beam 200, with differences including holes 106 as described with respect to the beam 100. The holes 106 make the beam 300 lighter with only a negligible reduction in beam strength.

The beams 10, 100, 200, 300 can be used to create a variety of rafters, columns or other structural supports. Furthermore, arches can be manufactured by joining a plurality of beams 10, 10, 200, 300 using methods well known in the art such as welding or using connecting sections.

FIG's 8 to 12 will describe various connections that may be made to connect beams 10, 100, 200, 300 to construct a framework of a building.

Figure 8:
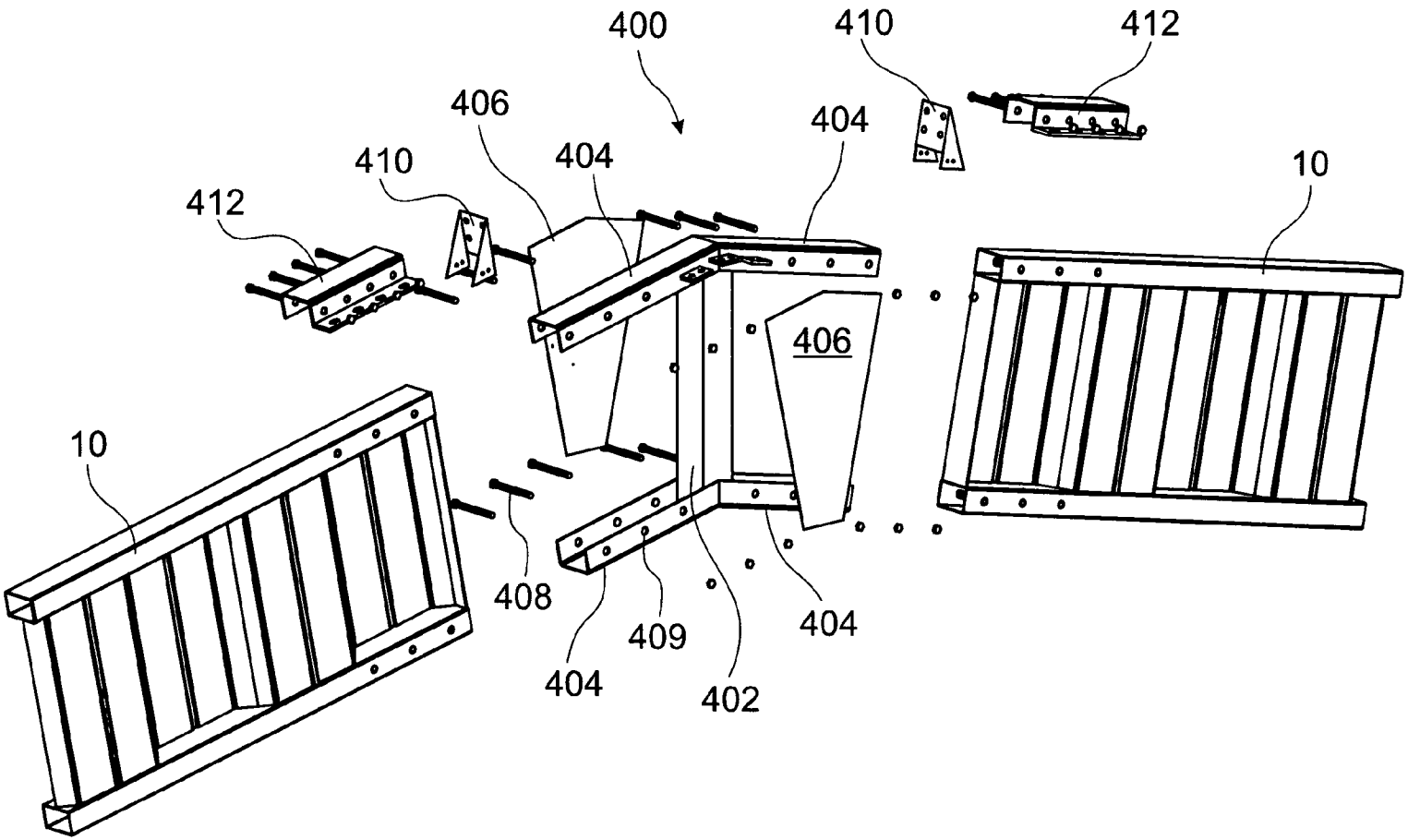
FIG. 8 shows a perspective exploded view of a building element in accordance with one aspect of the invention in the form of a rafter comprising a connector and the beams of FIG. 1.
Figure 9:
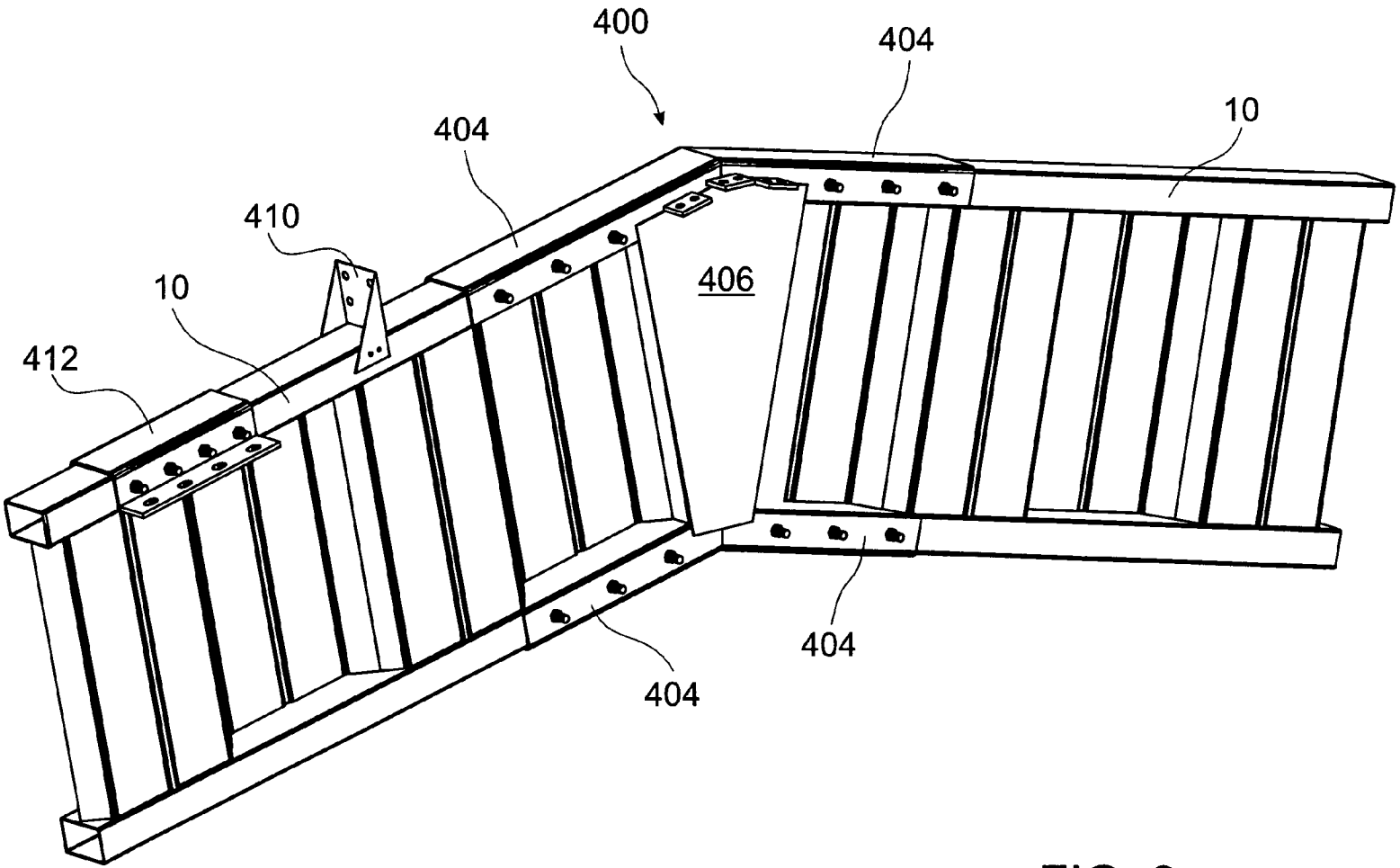
FIG. 9 shows an assembled perspective view of the building element of FIG. 8.

FIG. 8 shows a perspective exploded view of a rafter connector 400 for connecting two beams 10, and FIG. 9 shows a perspective assembled view of the rafter connector 400 and the beams 10. The rafter connector 400 allows beams 10 to be coupled together at the apex angle of a proposed roof. The rafter connector 400 consists of a central post 402 and pairs of holding channels 404 projecting at an angle from opposite sides of the post 402. The holding channels 404 are substantially U-shaped in cross section with open sides of opposite holding channels 404, of each pair of channels 404, facing each other. The beams 10 are secured to the rafter connector 400 by capturing each beam 10 between a pair of holding channels 404 in an arrangement wherein end regions of the flanges 16,18 of each beam 10 are each received in a different channel 404. The beams 10 are fixed to the rafter connector 400 by bolts 408 which extend through holes 409 in the channels 404 and the flanges 16, 18. Additionally, the beam 10 may be connected to the connector 400 by rivets, welding, soldering, gluing or any other applicable joining mechanism. Face plates 406 cover gaps in the assembled rafter connector 400. Purlin cleats 410 and bracing connectors 412 are fixed to the assembled rafter connector 400 and beams 10, for forming a roofing structure.

Figure 10:
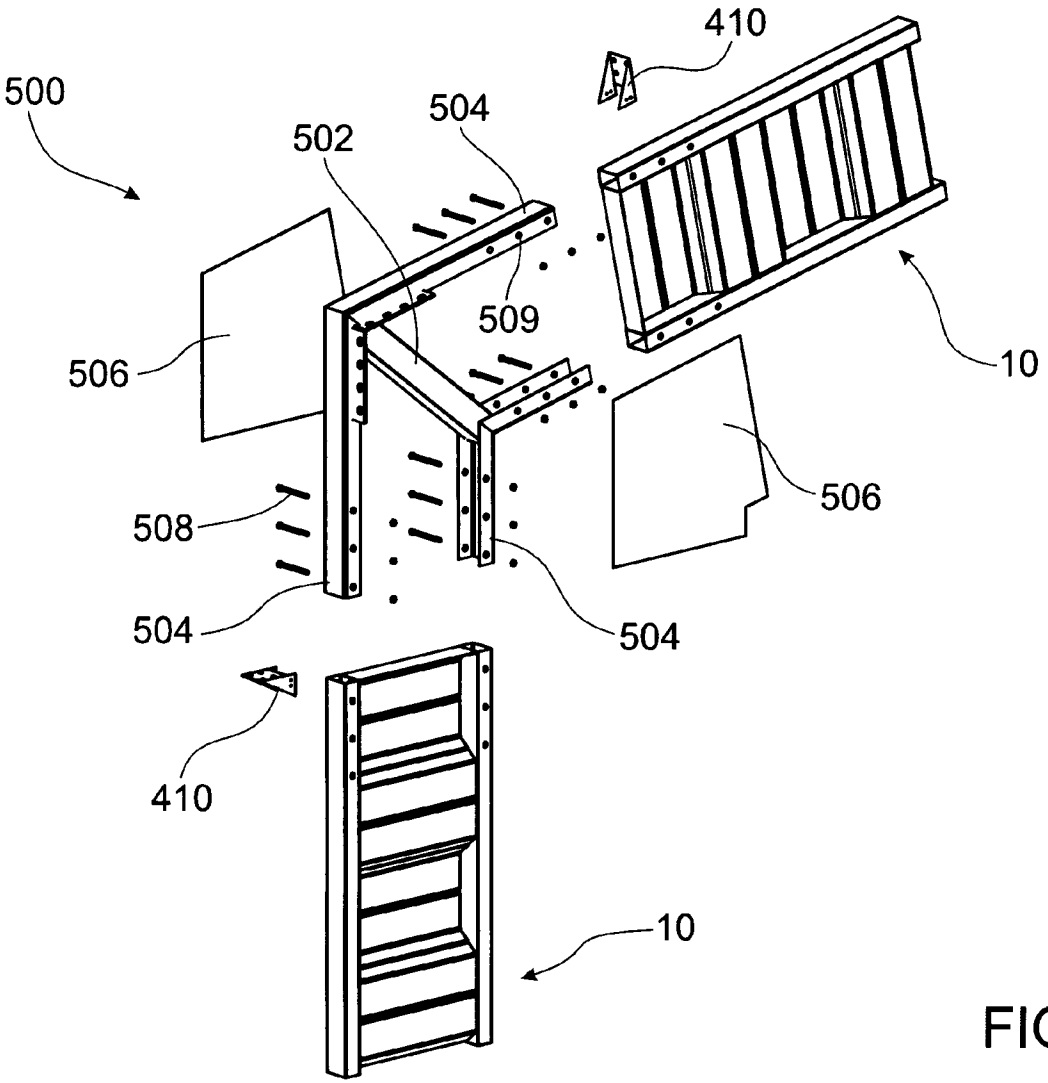
FIG. 10 shows a perspective exploded view of another embodiment of a building element in accordance with one aspect of the invention, comprising a bracket and the beam of FIG. 1.
Figure 11:
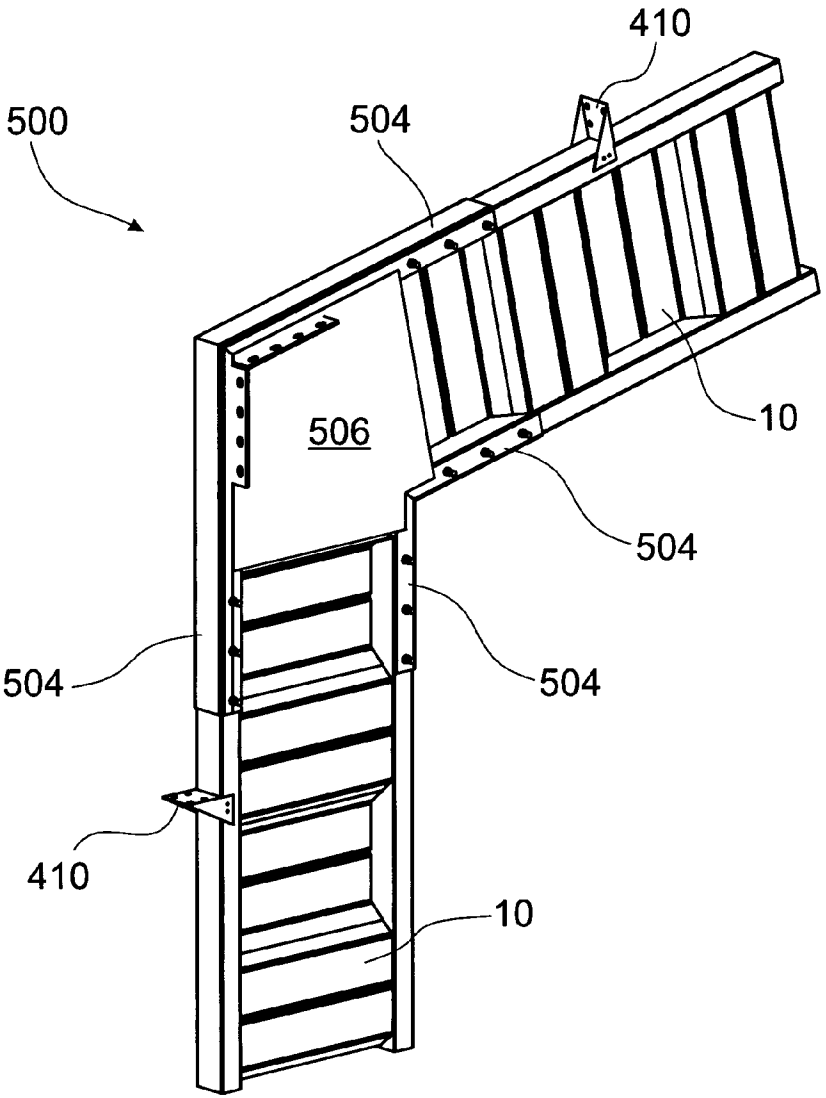
FIG. 11 shows a perspective assembled view of the building element of FIG. 10.

FIG. 10 shows a perspective exploded view of a knee connector 500 connecting beams 10 and FIG. 11 shows a perspective assembled view of the knee connector 500 and the beams 10. The knee connector 500 is similar to the rafter connector 400 in that it couples two beams 10 at an angle. The knee connector 500 joins the beams 10 at an angle which is 90 degrees plus the pitch angle of the proposed roof. The knee connector 500 consists of a central post 502 and pairs of channels 504 projecting at an angle from opposite sides of the post 502. The channels 504 are substantially U-shaped in cross section with open sides of opposite channels 504, of each pair of channels 504, facing each other. The beams 10 are secured to the knee connector 500 by capturing each beam 10 between a pair of holding channels 504 in an arrangement wherein end regions of the flanges 16, 18 of each beam 10 are each received in a different holding channel 504. The beams 10 are fixed to the knee connector 500 by bolts 508 which extend through holes 509 in the holding channels 504 and the flanges 16, 18. Additionally, the beam 10 may be connected to the knee connector 500 by rivets, welding, soldering, gluing or any other applicable joining mechanism. Face plates 506 cover gaps in the assembled knee connector 500.

Figure 12:
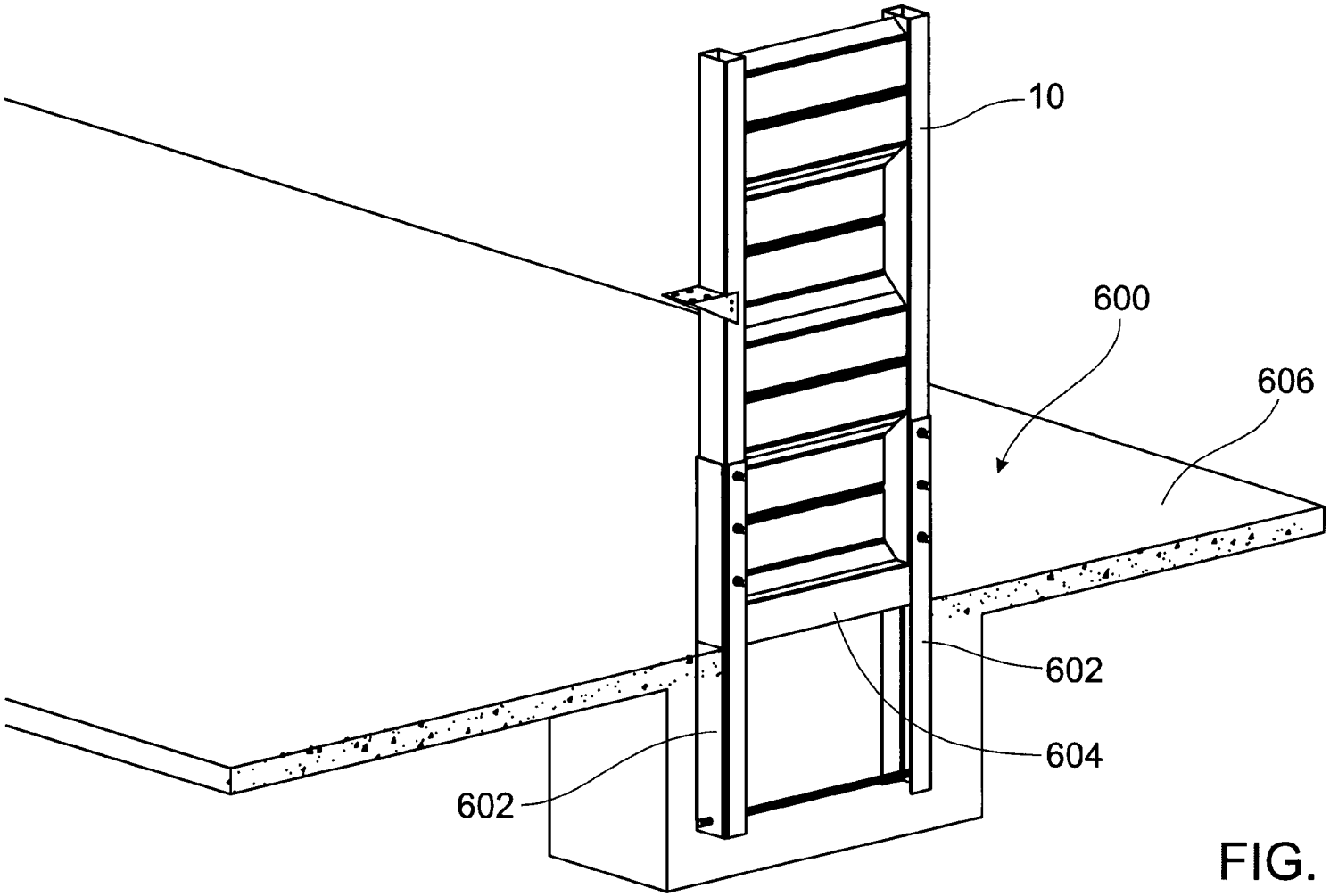
FIG. 12 shows a perspective view of a building element in accordance with an aspect of the invention comprising a bracket fixed to a building floor and the beam of FIG. 1 fixed to the bracket.

FIG. 12 shows a perspective view of a bracket in the form of a footplate 600 used to connect the beam 10 to footings used to support a building or structure. FIG. 12 shows a perspective view of the footplate 600 when connected to the beam 10. The footplate 600 is generally H-shaped comprising two parallel holding channels 602 and brace a 604 between the channels 602. The channels 602 are from steel and have a 'U' shaped cross-section, however any suitable material of any suitable cross-section may be used.

The footplate 600 is secured to the footings of the building by having one end of the footplate concreted into a floor 606 of the building, as would be known to a person skilled in the art or using any other applicable securing means. The flanges 16, 18 of the proximal end of the beam 10 are mounted and mechanically secured inside the upwardly projecting holding channels 602 of the footplate 600.

The embodiments described within this specification generally describe manufacture using steel. It should be appreciated that steel may not be the only suitable material and that aluminium or any other suitable material, such as fibre-glass, plastic or any other high strength material may be used. Mechanical joins described may involve, for example, welding, bolting, screwing, gluing, riveting, or chemically bonding materials together.

Advantages of the present invention include enabling large structural beams to be assembled from compact and portable components. For example, the webs 12 can be stamped or rolled in large volumes and then compactly stacked and shipped to a construction site. Also, the flanges 16, 18 can be identical and thus can be efficiently manufactured in large volumes, by for example cold roll forming, and then shipped to a construction site where the beams 10 are assembled. Additionally, the strengthening structures, such as the structures 38, allow any moisture trapped between the composite web 14 and the flanges 16, 18 to drain from the webs 12, preventing corrosion or rust.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. A method of constructing a beam, the method comprising:

providing a first flange and a second flange defining a central beam axis, wherein the first flange and the second flange each have a rectangular cross-section and each comprise a front surface, a back surface parallel to the front surface, a top surface, and a bottom surface parallel to the top surface;

providing a number of separately formed web sections each having two convergent side walls and a central wall extending between converging ends of the side walls, wherein the central wall includes a strengthening structure extending along the central wall perpendicular to the central beam axis, the strengthening structure comprising a fold in the central wall;

arranging the web sections side by side in an alternating arrangement wherein the central walls of adjacent web sections are spaced substantially parallel to each other and are transversely staggered relative to the central beam axis;

connecting the side walls of adjacent web sections to one another; and connecting the web sections to both the first flange and second flange.

2. The method of constructing a beam as claimed in claim 1, wherein the web sections are arranged so that edge regions of adjacent side walls overlap.

3. The method of constructing a beam as claimed in claim 2, wherein the method includes connecting the side walls of adjacent web sections to each other by passing fasteners through the region of overlap between adjacent side walls.

4. The method of constructing a beam as claimed in claim 1, wherein the side walls of adjacent web sections are welded to one another.

5. The method of constructing a beam as claimed in claim 1, wherein the central walls include gusset sections which extend past the upper or lower edges of the side walls and the method of constructing the beam includes positioning the flanges between the gusset sections.

6. The method of constructing a beam as claimed in claim 5, wherein the gusset sections are flush with the central walls of the web sections.

7. A method of constructing a building element which includes constructing at least two beams as claimed in claim 1, and rigidly connecting the beams at an angle relative to each other by inserting parts of the flanges of each of the beams into holding channels of a connector and fixing the beams to the connector.

8. A method of constructing a building element which includes constructing a beam as claimed in claim 1, inserting parts of the flanges into holding channels of a bracket, and fixing the beam to the bracket.

9. A beam comprising:

a first flange defining a central beam axis;

a second flange spaced parallel to the first flange, wherein the first flange and the second flange each have a rectangular cross-section and each comprise a front surface, a back surface parallel to the front surface, a top surface, and a bottom surface parallel to the top surface; and a number of separately formed web sections fixed between the first flange and the second flange, each of the web sections having two convergent side walls and a central wall extending between converging ends of the side walls, wherein the central wall includes a strengthening structure extending along the central wall perpendicular to the central beam axis, the strengthening structure comprising a fold in the central wall;

the web sections being arranged side by side in an alternating arrangement wherein the central walls of adjacent web sections are spaced substantially parallel to each other and are transversely staggered relative to the central beam axis, and the convergent side walls of adjacent web sections overlap.

10. The beam of claim 9, wherein the beam includes fasteners passing through a region of overlap between adjacent side walls.

11. The beam of claim 9, wherein the side walls of adjacent web sections are welded to one another.

12. The beam as claimed in claim 9, wherein the central walls include gusset sections which extend past the upper or lower edges of the side walls and the flanges are positioned between the gusset sections.

13. The beam as claimed in claim 9, wherein the central walls have holes defined therein.

14. The beam as claimed in claim 9, wherein the web sections comprise steel, aluminium, plastics or composite material.

15. A building element comprising:

two beams as claimed in claim 9; and a connector having two pairs of holding channels extending at an angle relative to each other, wherein parts of the flanges of each of the beams are received in a different pair of holding channels and fixed thereto.

16. A building element comprising:

a beam as claimed in claim 9; and a bracket having a pair of holding channels that receives ends of the first and second flanges.

17. The beam of claim 9, wherein the central wall of a first web section is coplanar with the front surfaces of the first flange and the second flange, and wherein the central wall of a second web section is coplanar with the back surfaces of the first flange and the second flange.

18. The beam of claim 9, wherein an angle between the central wall and each side wall is between 130 degrees and 150 degrees.

19. The beam of claim 9, wherein the web sections are capable of being stacked on each other.

* * * * *